United States Patent [19]

Glaser

[11] 4,393,334

[45] Jul. 12, 1983

[54] ELECTRON ACCELERATION IN IONIZABLE GAS

[76] Inventor: David Glaser, 1918 Raymond Dr., Northbrook, Ill. 60062

[21] Appl. No.: 232,972

[22] Filed: Feb. 9, 1981

[51] Int. Cl.[3] ..... H05B 41/16; H01J 61/62

[52] U.S. Cl. ..... 315/167; 313/308; 313/485; 315/169.4; 315/339; 313/584; 313/599; 313/621

[58] Field of Search ..... 313/188–190, 313/193–195, 210, 213, 214, 481, 484, 485, 307, 308; 315/167, 169.1, 169.4, 334, 337, 339; 340/781

[56] References Cited

U.S. PATENT DOCUMENTS 4,322,657 3/1982 Veith et al. ..... 313/485

*Primary Examiner*—Eugene R. La Roche

*Attorney, Agent, or Firm*—Edmond T. Patnaude

[57] ABSTRACT

A flat-panel gas discharge cathodoluminescent display includes a plurality of mutually parallel, electron-transmissive accelerator electrodes respectively connected to sources of high positive voltage levels to increase the acceleration voltage of the display without causing ionization of the gas.

18 Claims, 4 Drawing Figures

ELECTRON ACCELERATION IN IONIZABLE GAS

The present invention relates in general to the art of accelerating charged particles moving through a gas to high energy levels, and it relates in particular to a new and improved method and apparatus which enables the acceleration of electrons to high energy levels in the relatively short distances encountered, for example, in cathodoluminescent flat-panel displays.

BACKGROUND OF THE INVENTION

It is well known that charged particules may be accelerated by an electric field established between two electrodes. Where high energy levels of, for example, 5,000 eV are required, high potential differences of 5,000 or more volts are required to establish the necessary electric field. However, many factors place limitations on the maximum potential differences which can, as a practical matter, be provided. For example, ionization or breakdown of the gas is one limiting factor, and surface or material breakdown of the insulation which spaces the electrodes is another limiting factor.

The voltage at which ionization occurs is a function of the product of the gas pressure and the distance between the electrodes across which the voltage is applied, which product is hereinafter referred to as Pd. A plot of breakdown voltage vs. Pd provides the well-known Paschen Curve wherein breakdown voltage decreases with an increase in Pd in the region to the left of the minimum point of the curve. For maximum acceleration it is necessary to maintain the breakdown voltage as high as possible, but the minimum value of the pressure within the device is limited by constraints elsewhere in the device, such as when it is desired to use a hollow cathode of specific dimensions as an electron source. Similarly, since the surface material breakdown voltage decreases in proportion to the distance d between the electrodes, the minimum value of d is limited by the insulation materials available. Therefore, in the prior art the maximum accelerating voltage has been limited by the minimum pressure and minimum spacing available in the device.

In order to obtain high-energy electrons for exciting the luminescent materials on the display screen of a cathodoluminescent flat-panel display and for other purposes, it would be desirable to increase the breakdown voltage between electrodes for a given value of Pd. As a consequence, high accelerating voltages and resulting higher electron velocities can be provided with a concomitant increase in the brightness and luminous efficiency of the display.

SUMMARY OF THE INVENTION

Briefly, in accordance with one aspect of the present invention, the breakdown or ionization voltage between a cathode and an anode in an ionizable atmosphere is increased by positioning one or more electron-transmissive accelerator electrodes between the cathode and anode electrodes and connecting the intermediate accelerator electrode or electrodes and the anode electrode to sources of successively higher biasing voltages. The voltage differences between the mutually adjacent electrodes are maintained below the breakdown voltage for the Pd between the respective electrodes wherefor ionization of the gas between adjacent electrodes cannot occur. Therefore, although the distance between the cathode and anode electrodes remains the same, and the gas pressure remains the same, the effective Pd between the cathode and anode electrodes is increased by a factor of up to the number of intermediate electrodes used plus one. As a consequence, the ionization or breakdown voltage may be substantially increased for a given pressure and overall electrode spacing. In a reduction to practice of the invention, the effective Pd was increased by a factor of five by placing four accelerator electrodes between the anode and cathode.

In accordance with another aspect of the present invention the effective Pd between electron-transmissive electrodes can be increased by the use of thin, foil-like electrodes having tiny holes through which the electrons may pass. I have found that the effective distance between fixedly positioned, adjacent electrodes is decreased as the hole size through the electrodes is decreased. When this aspect of the invention is incorporated into a flat-panel television display, the holes may be arranged in a pattern of rows and columns in registration with the luminescent elements on the screen whereby these electrodes also function as a shadow mask with each hole or aperture confining the beam and thus limiting the divergence of the beam. When used in a color display, these accelerator electrodes thus maintain color purity.

Also, I have found that the voltage between the accelerating electrodes can be increased by utilizing holes of narrow, slot-like configuration rather than using round holes. Still greater accelerating voltages can be used when accelerating electrodes formed of fine mesh screen are used. The effective distance between adjacent electrodes is a function of the narrow dimension or width of the slots while the greater area of the slots enables a larger number of electrons to pass therethrough. In this manner, the effective hole size for controlling the breakdown voltage can be increased.

GENERAL DESCRIPTION OF THE DRAWINGS

The present invention will be better understood by a reading of the following detailed description taken in connection with the accompanying drawings wherein.

DETAILED DESCRIPTION OF THE INVENTION

In its broader aspects the present invention finds use wherever it is desirable to increase the breakdown voltage between electrodes in an ionizable atmosphere. Therefore, while the invention is described herein in connection with a cathodoluminescent flat-panel display, it will be understood that it is not so limited and may be used, for example, in laser technology where it may be used to increase E/P and therefore increase laser efficiency.

Figure 1:
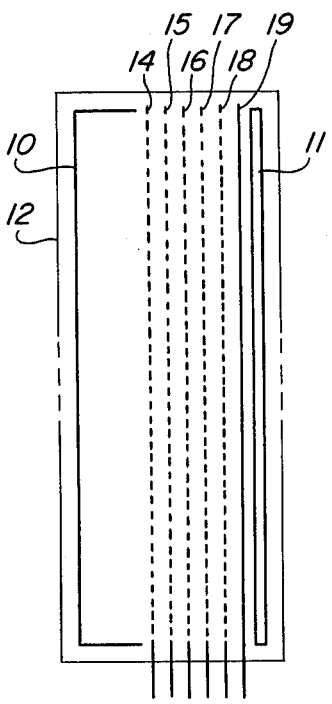
FIG. 1 is a cross-sectional view of a relatively simple electron accelerator system embodying the present invention.

Referring to FIG. 1 of the drawing, electrons are extracted from a source of free electrons 10 and accelerated against a target 11. The entire structure is enclosed in an enclosure 12 defining a hermetically sealed chamber containing an ionizable gas, and the source 10 may be a hollow cathode in which a gas discharge is maintained. An electron-transmissive extractor electrode 14 is connected to a source of voltage (not shown) which is positive relative to the cathode and which draws electrons from the gas discharge within the hollow cathode and accelerates them toward the target 1. In accordance with the invention, a plurality of additional electron-transmissive accelerating electrodes 15, 16, 17, and 18 are positioned in spaced, parallel relationship between the electrode 14 and an electron-transmissive anode 19 located in proximity to the target screen 11. These intermediate accelerator electrodes 15–18 and the ultor anode electrode 19 are respectively connected to low-impedance sources of increasingly higher positive voltage, the voltage differences between each pair of mutually adjacent electrodes being less than the gas-breakdown and surface-breakdown voltages therebetween. Inasmuch as the voltage differences between adjacent electrodes are established and fixed by the voltage sources to which the electrodes are connected, ionization or glow discharge between adjacent electrodes cannot be sustained.

As is explained in greater detail hereinafter, the use of the intermediate acceleration electrodes enables the use of a considerably higher overall electric field for a given gas pressure and overall electrode spacing. Consequently, by employing the intermediate electrodes to prevent breakdown of the gas between adjacent electrodes the electrons can be accelerated to considerably higher energy levels than would otherwise be possible.

While the present invention in its generic aspects has many applications, it is described hereinafter as applied to a flat-panel, cathodoluminescent alphanumeric or television display such as described in copending applications Ser. No. 051,152, filed June 22, 1979, and Ser. No. 182,782, filed Aug. 29, 1980, now U.S. Pat. Nos. 4,303,847 and 4,339,482, respectively. This invention may be utilized in such a display because of the fact that the electrodes may be made of a compliant material such as wire mesh or perforated metal foil so as to conform to the glass pane providing the principal structural support member in the panel. Moreover, when the invention is embodied in an alphanumeric or television display panel, metal foil electrodes having rows and columns of holes or apertures in mutual alignment with correspondingly arranged phosphor elements on the target or display screen is desirable. The use of such holes, which may, for example, be one-third the size of a pixel in a color television display, increases the ionization breakdown voltage for a given gas pressure and panel thickness, and in addition, the accelerator electrodes function as a shadow mask which physically maintains color and picture purity.

Figure 2:
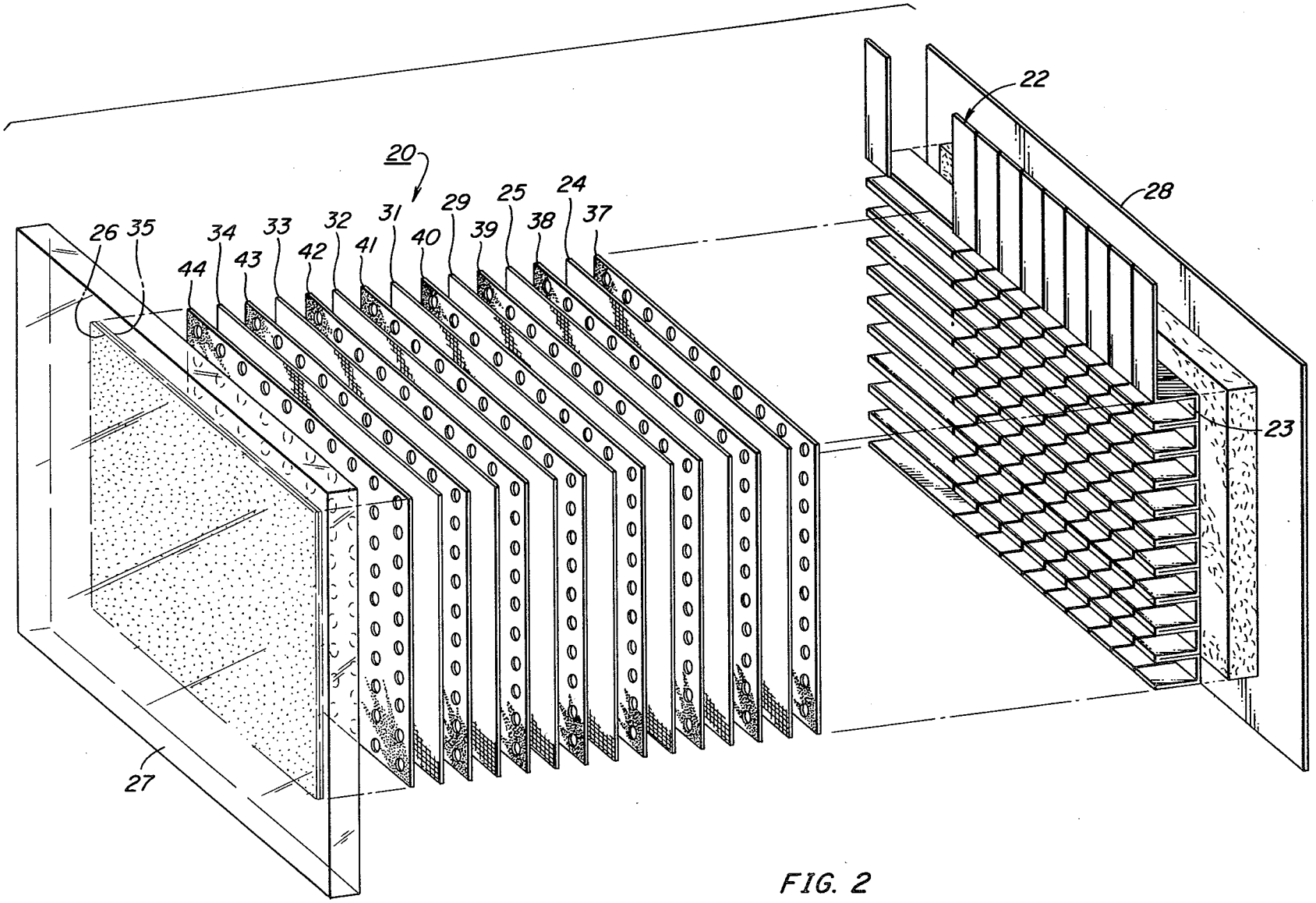
FIG. 2 is an exploded perspective view of a flat-panel display embodying the present invention.

Referring to FIG. 2, a flat-panel display 20 is shown in exploded, perspective form. The panel shown is for scanning a raster of ten horizontal rows and ten vertical columns and may be used for displaying information in pictorial or alphanumeric form. It will be understood, however, that any suitable number of rows and columns may be used. The display 20 includes a hollow-cathode assembly 22 comprising a plurality of mutually parallel, open channels 23 in which a gaseous glow discharge occurs in the manner described in copending application Ser. No. 06/320,324 filed Nov. 12, 1981. Free electrons in the gas-discharge are extracted by the positive potential of an electron-transmissive extractor electrode 24, and the electrons passing through the electrode 24 are focussed into a sharp discrete beam by the relative potential of an electron-transmissive repeller electrode 25 and extractor electrode 24. The electron beam which is thus transmitted through the repeller electrode is directed toward a target or display screen 26 mounted against the rear face of a glass pane 27 at the front of the panel.

After passing through the repeller electrode 25 the electrons are at a relatively low energy spread and this low-energy-spread electron beam is modulated by an information voltage signal applied to an electron-transmissive modulation electrode 29. In a television display, the video signal is applied to the electrode 29.

In order to accelerate the electrons in the modulated beam passing through the electrode 29 to the high energy levels required to excite the luminescent material on the target screen 26, a plurality of electron transmissive accelerator electrodes 31, 32, 33 and 34 are positioned in spaced, parallel relationship between the modulation electrode 29 and an electron-transmissive anode 35 disposed in proximity to the target screen 26. The electrodes 31, 32, 33 and 34 may be wire mesh screens, but preferably they are thin, metal foil sheets or the like provided with small holes arranged in a pattern of horizontal rows and vertical columns in registration with rows and columns of luminescent elements making up the target screen 26. The electrode 35 constitutes the ultor anode and while it may also be a wire mesh screen or a perforated thin metal sheet, it is preferably an imperforate metal sheet which is sufficiently thin to transmit the electron beam therethrough for bombardment of the luminescent material on the target screen 26.

The electrodes are supported in spaced relationship and insulated from one another by a plurality of thin insulating sheets 37, 38, 39, 40, 41, 42, 43 and 44 having holes or apertures therein arranged to permit the electron beam to pass therethrough. Preferably these holes are in registration with the luminescent elements on the screen 26 although screens or other electron transmissive electrode structures may be used.

Although the optimum voltage levels at which the various electrodes in the panel 20 are biased will vary with the particular panel size, materials used, and panel design, as an example, the following voltage values may be used in a cathodoluminescent television display panel using neon at a pressure of 3.5 Torr as the ionizable gas:

| | |
|---|---|
| Cathode 22 | ground potential |
| extractor electrode 24 | +300 volts |
| repeller electrode 25 | +200 volts |
| modulation electrode 29 | +180 volts |
| acceleration electrode 31 | +1180 volts |
| acceleration electrode 32 | +2180 volts |
| acceleration electrode 33 | +3180 volts |
| acceleration electrode 34 | +4180 volts |
| ultor anode electrode 35 | +5180 volts |

The panel 30 may be of any design which maintains within the panel a gaseous atmosphere which will support the necessary gas discharge within the hollow cathode to provide a source of free electrons. A noble gas such as neon or helium or a combination of noble gasses at a pressure of between 0.5 Torr and 15 Torr will provide such an atmosphere.

The insulating layers 37–44 may be sheets of aluminum oxide having a thickness of about 250 microns to prevent surface breakdown of the insulating layers at a voltage difference of 1000 volts between electrodes.

For optimum results the minimum dimension of the holes or apertures in the electrodes 23, 24, 29 and 31–34 should be less than the Debye length of the plasma at the pressure within the panel, and the holes or apertures through the insulating sheets are preferably the same size or larger. Where the electrodes are metal sheets having holes therein, the holes in the insulating sheets should be aligned with the holes in the metal sheets.

Figure 3:
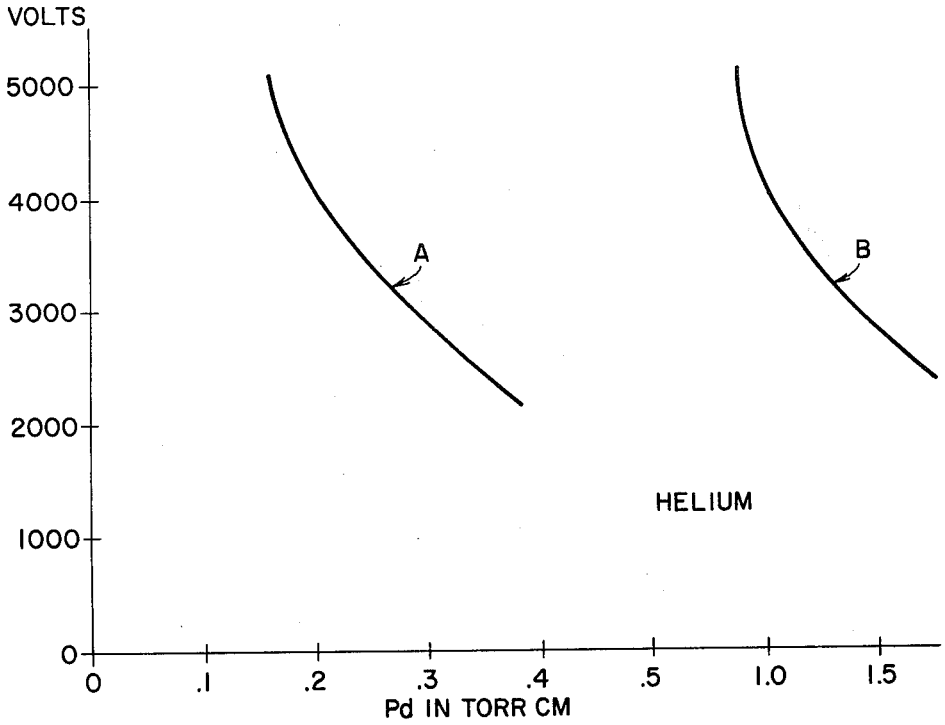
FIG. 3 is a graph of two Paschen Curves useful in understanding one aspect of the present invention.

For a better understanding of the increase in breakdown voltage which may be achieved by means of the electron transmissive accelerator electrodes of the present invention, reference is now made to the graph of FIG. 3 showing the relationship between Pd in Torr-centimeters and the breakdown voltage in kilovolts.

The curve A at the left was plotted from data obtained using a cathode and an anode with no accelerator electrodes therebetween to control the electric field between the cathode and the anode. The value of d was the distance between the cathode and the anode.

The curve B at the right was plotted from data obtained using the same overall configuration but using four additional accelerator electrodes interposed between the cathode and anode. The voltages on these intermediate accelerator electrodes were set at equal increments.

It may be seen from an inspection of FIG. 3 that the Pd for a given breakdown voltage is substantially increased by the use of the intermediate accelerator electrodes.

Figure 4:
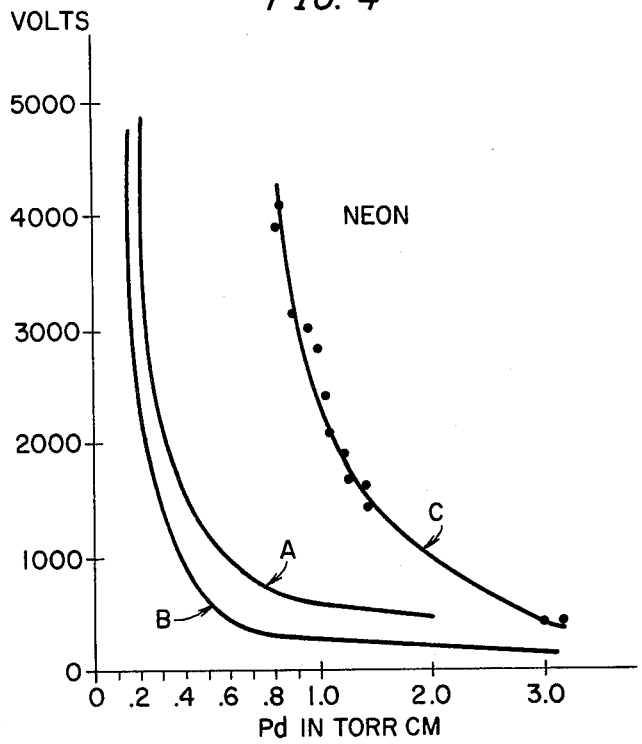
FIG. 4 is another graph showing three Paschen Curves useful in understanding another aspect of the present invention.

As described hereinabove, the ionization voltage may be increased by reducing the sizes of the holes through the insulating sheets separating the accelerator electrodes. Referring to FIG. 4, there are shown two Paschen curves obtained by plotting breakdown voltage vs. Pd using a hole size of 0.040 inch diameter for curve A and using a hole size of 0.5 inch for curve B in a neon atmosphere. It may be seen that the ionization voltage increases as the hole size is decreased.

As described hereinabove, for a given electrode spacing the breakdown voltage between two electrodes may be increased by reducing the sizes of the holes through the insulating sheets separating the electrodes. Assuming the holes to be circular, as the diameter of the holes is decreased the effective distance d, traveled by the electrons passing therethrough is decreased because of the altered electric-field distribution. Consequently, the effective Pd is decreased while the actual values of P and d remain constant, wherefor a higher accelerating voltage may be used within the constraints of a given display panel.

Referring to FIG. 4, there are shown three Paschen curves obtained by plotting the breakdown voltage vs. Pd between two electrodes in an inert gaseous atmosphere in a laboratory model. Each data point on the curves was obtained by adjusting the value of P to set the value of Pd and then increasing the voltage across the electrodes until a glow was observed when breakdown occurred.

The device used to obtain curve A employed a pair of wire mesh electrodes spaced apart by a sheet of insulation having a thickness of 120 mils., and a circular hole having a diameter of 40 mils. The electron-insulator assembly was sealed between two glass plates and the ionizable gas was introduced through a tubulation in one of the glass sheets. The gas used was neon.

The device used to obtain the curve plotted for curve B was the same as that used for obtaining the data for curve A except that the hole through the insulating sheet had a diameter of 500 mils.

A comparison of curves A and B shows that the breakdown voltage across an apertured insulator varies inversely with the diameter of the aperture.

The data plotted along curve C was obtained from a laboratory device in which five apertured sheets of insulation were respectively laminated between six wire mesh screens. The insulating sheets each had a thickness of 9 mils, and the electrodes were 325 mesh stainless-steel screens each having a thickness of about 3 mils. The electrode stack was sealably sandwiched between two glass plates with a tubulation extending through one of the plates. Neon was introduced into the device through the tubulation and the gas pressure in the device was set to provide the different values of Pd. While the Pd was held at each data point on the curve the voltages across the electrodes were increased until breakdown occurred and a glow was detected. The total voltage was equally divided between the electrodes as the total voltage across the electrode stack was increased. For example, when the total voltage was 2000 volts, the voltage difference between the mutually adjacent electrodes was 400 volts.

Curve C was theoretically calculated by multiplying the breakdown voltage which would occur across a 120 mil gap without intermediate accelerator electrodes by five, the number of accelerator electrodes. It may be seen that the data points which were empirically determined and plotted in FIG. 4 closely conform to the theoretical curve C. It should be noted that the intermediate electrodes did not draw any significant current during these tests.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come with the true spirit and scope of this invention.

What is claimed is:

1. In a gas-discharge device of the type having a generally planar cathode for emitting electrons and a generally planar anode for accelerating said electrons toward a luminescent target, said anode and said cathode being mutually parallel and the space between said cathode and said anode containing an ionizable gaseous atmosphere, the combination comprising a plurality of planar electron-transmissive accelerator electrodes mounted in spaced parallel relationship between said cathode and said anode, insulator means insulating said electrodes from one another and from said cathode and said anode, and permitting said electrons to pass as they travel from said cathode toward said target, and means connecting to said electrodes voltages which are respectively positive relative to the voltage level of said cathode, which voltages increase in value from the one of said electrodes which is closest to said target, the voltage difference between adjacent ones of said accelerator electrodes being less than the ionization voltage and the surface breakdown voltage therebetween, said electron-transmissive accelerator electrodes are respectively provided with a plurality of holes through which said electrons must pass as they travel from said cathode to said anode, and the minimum dimension of said holes being less than the Debye length of the gaseous atmosphere in which they are located.

2. An accelerator as set forth in claim 1 wherein said insulator means insulating said electrodes from one another comprises electron-transmissive sheets of an insulating material.

3. An accelerator as set forth in claim 2 wherein each of said sheets is provided with a plurality of holes arranged in a regular pattern of rows and columns.

4. An accelerator as set forth in claim 3 wherein said target comprises a plurality of luminescent areas arranged in a regular pattern in registry with said regular pattern of rows and columns.

5. An accelerator as set forth in claim 4 wherein at least one of said electrodes comprises a metal layer having a plurality of holes aligned with said holes in said sheets of an insulating material.

6. An accelerator as set forth in claim 5 wherein said plurality of holes in said metal layer are slots.

7. An accelerator as set forth in claim 5 wherein said metal layer comprises a mesh screen.

8. An accelerator as set forth in claim 7 wherein said voltages between adjacent ones of said electrodes are equal to one another.

9. An accelerator as set forth in claim 1 wherein said voltages between adjacent ones of said electrodes are equal to one another.

10. An accelerator as set forth in claim 1 wherein said accelerator electrodes and said means insulating said electrodes comprise interleaved, perforated sheets.

11. The combination according to claim 1 wherein said accelerator electrodes respectively comprise wire mesh screens.

12. The combination according to claim 11 wherein said insulator means comprises a plurality of sheets of insulating material each having a plurality of holes therethrough arranged in a regular pattern of rows and columns, said holes being larger than the holes through said screens.

13. The combination according to claim 1 wherein said holes are of narrow slot-like configuration.

14. A method of reducing the effective Pd between a cathode and an anode disposed in an ionizable gaseous atmosphere comprising the steps of positioning between said cathode and said anode in mutually spaced parallel relationship a plurality of planar electrodes each having a plurality of holes therethrough whose respective minimum dimensions are less than the Debye length of said gaseous atmosphere, and connecting said electrodes to respective ones of a plurality of sources of voltages having voltage levels intermediate the operating voltages of said cathode and said anode, the voltage differences between adjacent ones of said electrodes being less than the ionization voltage and the surface breakdown voltage therebetween.

15. A method according to claim 14 wherein said step of positioning comprises interleaving metalic mesh screen electrodes and perforated insulating sheets between said anode and said cathode.

16. A method according to claim 14 wherein said electrodes are perforate sheets and comprising the further step of positioning perforate sheets of insulation between said electrodes.

17. A method according to claim 16 comprising the further step of mutually aligning the perforations in said sheets of insulation.

18. A method according to claim 16 comprising the further step of aligning the perforations in said sheets of insulation with the perforations in said electrodes.

* * * * *